US007077437B2

(12) United States Patent
Huang

(10) Patent No.: US 7,077,437 B2
(45) Date of Patent: Jul. 18, 2006

(54) MORTISE LOCK INTEGRATED TRIM ASSEMBLY WITH A RETRACTING SPINDLE

(75) Inventor: Richard Hai Huang, West Haven, CT (US)

(73) Assignee: Sargent Manufacturing Company, New Haven, CT (US)

( * ) Notice: Subject to any disclaimer, the term of this patent is extended or adjusted under 35 U.S.C. 154(b) by 1 day.

(21) Appl. No.: 10/811,464

(22) Filed: Mar. 26, 2004

(65) Prior Publication Data

US 2005/0212306 A1 Sep. 29, 2005

(51) Int. Cl.
*E05B 3/00* (2006.01)

(52) U.S. Cl. ..... 292/336.3; 292/163; 292/173; 292/347; 292/348; 292/DIG. 53; 292/DIG. 64; 70/224; 70/479

(58) Field of Classification Search ..... 292/336.3, 292/163–165, 173, 347–349, 353–355, DIG. 53, 292/DIG. 61, DIG. 64; 70/224, 479; 16/412
See application file for complete search history.

(56) References Cited

U.S. PATENT DOCUMENTS

| | | | | | |
|---|---|---|---|---|---|
| 290,247 | A * | 12/1883 | Lattimer | 292/348 |
| 305,426 | A * | 9/1884 | Clark | 292/348 |
| 330,187 | A * | 11/1885 | Alvord | 292/348 |
| 1,706,598 | A * | 3/1929 | Archer et al. | 292/348 |
| 2,105,617 | A * | 1/1938 | Shaw | 292/347 |
| 2,128,144 | A * | 8/1938 | Heinen | 292/358 |
| 2,947,561 | A * | 8/1960 | Holden | 292/347 |
| 3,471,190 | A * | 10/1969 | Turnbull et al. | 292/356 |
| 4,067,599 | A | 1/1978 | Ohno | |
| 4,460,204 | A * | 7/1984 | Olsen | 292/356 |
| 4,502,720 | A * | 3/1985 | Fayerman et al. | 292/348 |
| 4,517,865 | A * | 5/1985 | Huang | 81/475 |
| 4,526,256 | A * | 7/1985 | Urdal | 192/40 |
| 4,569,547 | A | 2/1986 | Fayerrman et al. | |
| 4,667,994 | A * | 5/1987 | Foshee | 292/358 |
| 4,728,133 | A * | 3/1988 | Valley | 292/336.3 |
| 5,685,584 | A * | 11/1997 | Baren et al. | 292/358 |
| 5,730,014 | A * | 3/1998 | Berger et al. | 70/422 |
| 5,787,744 | A * | 8/1998 | Berger et al. | 70/422 |
| 5,813,708 | A * | 9/1998 | Shen | 292/165 |
| 5,941,108 | A * | 8/1999 | Shen | 70/467 |
| 6,231,092 | B1 * | 5/2001 | Shields et al. | 292/347 |
| 6,349,982 | B1 * | 2/2002 | Fayngersh et al. | 292/165 |
| 6,398,274 | B1 * | 6/2002 | Huang et al. | 292/358 |
| 6,425,273 | B1 * | 7/2002 | Kim et al. | 70/224 |
| 6,527,314 | B1 * | 3/2003 | Brown | 292/336.3 |
| 6,619,710 | B1 * | 9/2003 | Hwang | 292/336.3 |
| 6,626,018 | B1 | 9/2003 | Eller et al. | |
| 6,893,059 | B1 * | 5/2005 | Shen | 292/169 |

* cited by examiner

*Primary Examiner*—Brian E. Glessner
*Assistant Examiner*—Carlos Lugo
(74) *Attorney, Agent, or Firm*—DeLio & Peterson, LLC

(57) ABSTRACT

An integrated mortise lock trim mechanism is provided for mounting on the surface of a door and has a handle turning a spindle that extends into the door to operate a lock mechanism mounted therein. The trim assembly is pre-assembled and has a retracting spindle that extends between the trim mechanism and the lock mechanism to accommodate varying door thicknesses. The preferred assembly utilizes a cover plate, spring and mounting plate assembly holding a pair of alignment through bolts. This assembly is fit onto a door handle and secured to the door handle by a cap nut. An elongated spring is disposed in the handle and is secured to a spindle which axially extends from the handle. The spindle is automatically retracted or extended to optimally fit into the hub of a mortise lock.

16 Claims, 5 Drawing Sheets

MORTISE LOCK INTEGRATED TRIM ASSEMBLY WITH A RETRACTING SPINDLE

BACKGROUND OF THE INVENTION

1. Field of the Invention

The present invention relates to door locks, particularly mortise locks, in which a trim mechanism mounted on the surface of the door has a handle turning a spindle that extends into the door to operate a lock mechanism mounted therein. More specifically, the present invention relates to a preassembled integrated trim assembly having a retracting spindle that extends between the trim mechanism and the lock mechanism to accommodate varying door thicknesses.

2. Description of Related Art

Mortise locks typically have a pair of trim mechanisms mounted on opposite faces of a door to operate the lock mechanism mortised into the door. The lock mechanism includes a latchbolt that engages the strike plate on door frame to latch the door closed and the trim mechanisms include corresponding handles that allow the user to open the door by retracting the latchbolt when the door is unlocked.

In this type of design, the retraction of the latchbolt into the lock mechanism is achieved by operating a handle which turns a spindle extending from the trim mechanism to the lock mechanism. Different types of handles may be incorporated into the trim mechanism, such as lever handles, conventional knob handles, and paddle handles, etc., depending upon the intended use of the door. Knob handles are commonly used in private buildings. Lever handles are often used in public buildings and paddle handles are often found in hospitals or other locations where it is desirable to operate the door without grasping the handle with the hand.

In lever handles and knob handles, the spindle is usually turned directly by the handle. Rotating the handle turns the spindle which operates the lock mechanism. In paddle handles, there is a linkage or cam mechanism that converts an inward motion of the handle to spindle rotation. The subject invention is applicable to any type handle and for convenience the following description will be directed to lever handles.

In mortise locks, the lock mechanism is typically mounted halfway between the two opposed faces of the door (at the midplane of the door), and the handle trim mechanisms are surface mounted on the opposed faces of the door. Because doors can have different thicknesses, the distance from the face of the door to the midplane of the door will vary. Accordingly, the length of the spindle also varies, as it must correspond to the thickness of the door. The correct length for the spindle is particularly important for mortise locks that are designed with a pair of independent coaxial spindle hubs. This design allows handles on opposite sides of the door to be locked and operated independently.

With a pair of independent spindle hubs, the hubs are symmetrically located within the lock mechanism on opposite sides of the midplane of the door and the spindle from each trim mechanism cannot extend past the door midplane. If a spindle is too short, it will not fully engage its corresponding spindle hub. Alternatively, if the spindle is too long, it will bind and may jam the locking mechanism or the trim mechanism. The spindle length must be correct for the door thickness.

The need to match the spindle length to the door thickness is inconvenient, as the installer of the door lock must know the thickness of the door. It is also inconvenient for the supplier who must supply multiple spindles to match different door thicknesses or require that the purchaser specify the door thickness when the lock is purchased. Errors in selecting and installing the correct spindle are common and result in locks that jam, bind or fail to operate correctly. A related problem is that removable or replaceable spindles may fall out during handling or become misplaced before or during installation.

It is also desirable to provide an integrated trim assembly which is pre-assembled and factory adjusted. The integrated trim assembly incorporates a decorative cover (rosette or escutcheon), a mounting plate, through bolt posts, a retractable spindle and a handle (lever or knob). Such an assembly enables ease of installation, avoids field adjustment and less error during installation. FIG. 9 for example, shows a typical prior art trim assembly comprising a number of parts which must be assembled during installation or installed separately.

The present invention relates to solving the above problems where the lock mechanism is mounted in the door and has at least one surface mounted trim mechanism on the surface of the door. It is generally directed to the case where the trim mechanism has a spindle which cannot extend beyond some maximum depth, to prevent binding, but must extend to at least some minimum depth to properly engage the lock mechanism, and, more specifically, to a mortise lock having independent coaxial spindle hubs.

Bearing in mind the problems and deficiencies of the prior art, it is therefore an object of the present invention to provide a spindle trim mechanism for operating a door lock which spindle automatically retracts to accommodate different door thicknesses.

It is another object of the present invention to provide an automatic retracting spindle trim mechanism for operating a door lock in doors of different thicknesses and which comprises an integrated assembly which may be pre-assembled and does not have separate loose parts.

Still other objects and advantages of the invention will in part be obvious and will in part be apparent from the specification.

SUMMARY OF THE INVENTION

The above and other objects, which will be apparent to those skilled in the art, are achieved in the present invention which is directed to an integrated door lock handle and trim assembly having a retractable spindle for operating a mortise door lock comprising:

- a door lock handle having a support shoulder and external threads at the end of the handle and an axial blind opening in the handle for accommodating a spring and a spindle;
- a cover (rosette) having a base and a door facing outer lip around the base periphery and an internal threaded through opening in the base which opening is sized to allow the cover to rotate freely on the handle and the base rests against the shoulder;
- a mounting plate sized to fit within the outer lip and having a through opening with a lip having external threads which are to be threaded with the internal threads of the cover;
- a cap nut having a through opening with internal threads which are to be threaded with the external threads of the handle forming an integral assembly of the handle, cover, mounting plate and cap nut;
- an elongated spring disposed within the axial opening of the handle having a front end and a rear end press-fit into and resting against the end of the blind opening; and an elongated spindle sized to extend through the cap nut opening, mounting plate opening and the axial opening in the handle and having a front end shaped to engage and operate the door lock and a rear end which is pressing against the front end of the spring;

whereas the spindle can be retracted within the axial opening decreasing the effective length of the spindle enabling the assembly to be used for doors of varying thicknesses.

In another aspect of the invention an integrated door lock handle and trim assembly having a retractable spindle for operating a mortise door lock is provided comprising:

a door lock handle having a support shoulder formed by an elongated extension of smaller size at the end facing the door with the handle having external threads at the end of the extension and an axial blind opening in the extension and handle for accommodating a spring and a spindle;

a cover (rosette) having a base and a door facing outer lip around the base periphery and an internal threaded through opening in the base which opening is sized to allow the cover to rotate freely on the extension and the base rests against the shoulder;

a mounting plate sized to fit within the outer lip and having a through opening with a lip having external threads which are to be threaded with the internal threads of the cover;

a cap nut having a through opening with internal threads which are to be threaded with the external threads of the handle forming an integral assembly of the handle, cover, mounting plate and cap nut;

an elongated spring disposed within the axial opening of the extension and handle having a front end and a rear end press-fit into and resting against the end of the blind opening; and an elongated spindle sized to extend through the cap nut opening, mounting plate opening and the axial opening in the handle and having a front end shaped to engage and operate the door lock and a rear end which is pressing against the front end of the spring;

whereas the spindle can be retracted within the axial opening decreasing the effective length of the spindle enabling the assembly to be used for doors of varying thicknesses.

In another aspect of the invention door and lock elongated mounting posts have an enlarged end held in the assembly with the free end of the posts extending through openings in the mounting plate. The enlarged end contacts a disc spring spacer in the assembly and allows limited axial and lateral movement of the pin which is important to assist the installer of the door lock. The mounting posts extend through the door and mortise lock case and are fastened with two screws from the other side of the door. The two mounting posts serve as through-bolts and provide extra support to secure the outside trim assembly.

In another aspect of the invention the cap nut has a star pattern face opening so that a square spindle, for example, when inserted through the opening of the cap nut and positioned in the star of the cap nut, prevents the cap nut from rotating and loosening the assembly.

In an additional aspect of the invention the rear end of the spindle has a blind hole which is provided with an anchor of which one end is press-fit into the blind hole on the spindle. The other end of the anchor is secured to a spring in the axial opening in the handle and enables the spindle to be retained and retracted in the assembly and prevents the spindle from falling out of the assembly during manufacture, shipping, and installation. The feature of spindle anchor can be an integral part of the spindle instead of a seperate piece. For example, the rear end of the spindle may have an umbrella or other shape which engages the spring and is secured to the spring.

In a further aspect of the invention the spring used with the spindle is elongated and has a back end which is conical in shape so that retraction of the spindle into the axial opening of the handle compresses the spring to a greater extent than a conventional coil spring. The last coil on the larger end of the conical spring press fits into the blind hole and retain the spring in the handle.

BRIEF DESCRIPTION OF THE DRAWINGS

The features of the invention believed to be novel and the elements characteristic of the invention are set forth with particularity in the appended claims. The figures are for illustration purposes only and are not drawn to scale the invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiments of the present invention, reference will be made herein to FIGS. 1–10B of the drawings in which like numerals refer to like features of the invention.

Figure 1:
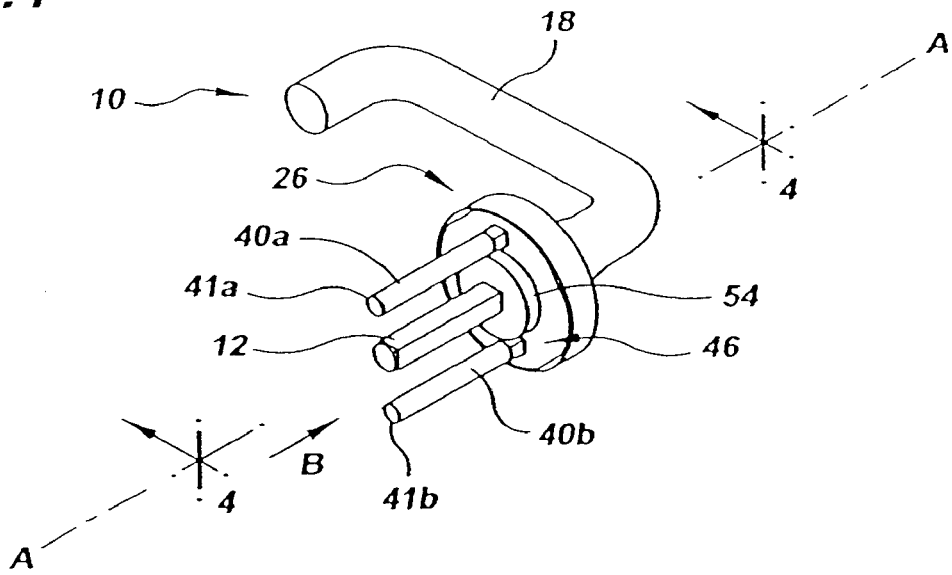
FIG. 1 is a perspective view of the mortise lock integrated trim assembly with a retracting spindle according to the present invention.

FIG. 1 shows a mortise lock integrated trim assembly with a retracting spindle as numeral 10 made according to the invention and includes a square spindle 12 having an axis A. The spindle can be retracted in the direction of arrow B.

Figure 9:
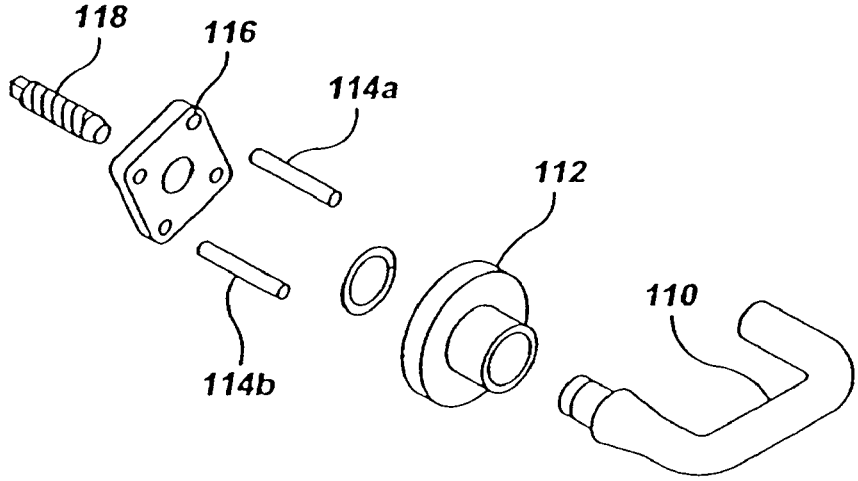
FIG.9 (PRIOR ART)
FIG. 9 is an exploded view of a number of parts used by an installer to make a trim assembly when installing a lock as in the prior art.

FIG. 9 shows a typical trim assembly comprising a number of loose parts. Thus, handle 110, cover 112, through posts 114*a* and 146*b*, mounting plate 116, and spindle 118 must be assembled on site. The subject invention avoids this and provides an integrated trim assembly with no loose parts.

Figure 8:
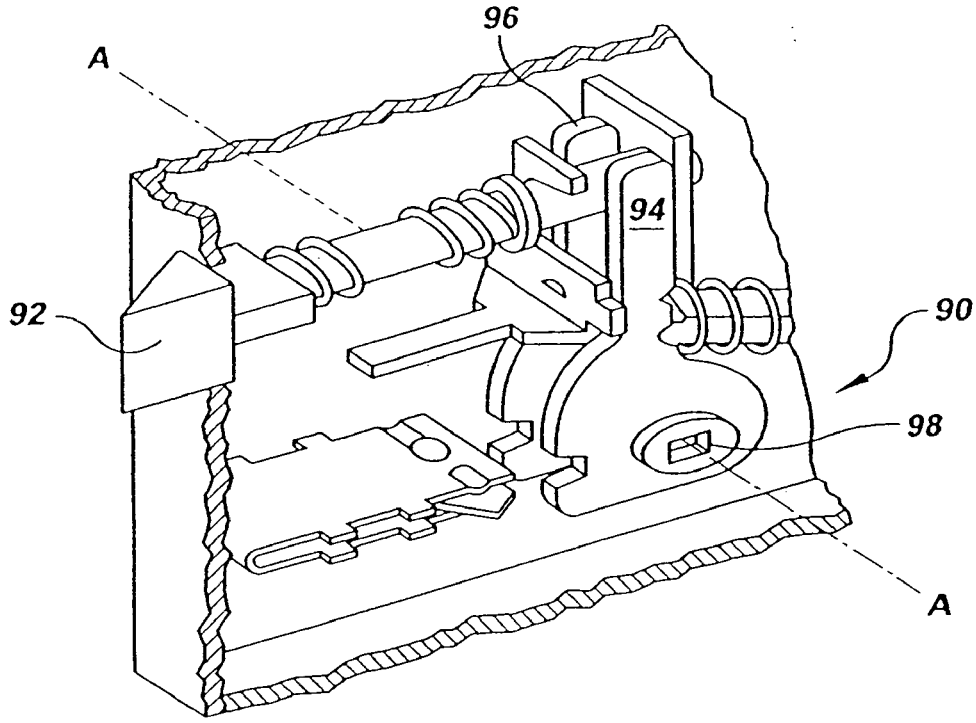
FIG.8 (PRIOR ART)
FIG. 8 is a perspective view of a portion of a prior art mortise lock having a pair of independent spindle hubs which may be operated by the retracting spindle trim assembly seen in FIG. 1.

FIG. 8 shows one prior art embodiment of a mortised door lock 90. The mortise lock 90 includes a latch bolt 92 which extends outward from the mortise lock 90 and engages a latch plate in a door frame. To open the door, the latch bolt 92 must be retracted from the latch plate (not shown) by rotating spindle hub 94 or spindle hub 96. The spindle hubs 94, 96 are each operated by a handle trim assembly, such as the assembly 10 of FIG. 1. A first trim mechanism is connected to and rotates spindle hub 94 and a second trim mechanism is connected to and rotates spindle hub 96. The trim assembly of FIG. 1 may be mounted on either side of the door to engage either spindle hub 94 or 96 in the mortise lock 90.

Spindle 12 has a square (rectangular) cross section and engages a corresponding square opening 98 in spindle hub 94. The spindle connected to spindle hub 94 must operate only spindle hub 94 and must not operate spindle hub 96 so that each trim mechanism operates only its corresponding spindle hub. This allows the mortise lock to lock the handles on opposite sides of the door differently. Thus, opening 98 has a limited depth (usually a blank is provided between the hubs 94 and 96) and the spindle 12 is preferably inserted fully into the opening 98 in order to maximize the contact between the spindle 12 and its corresponding spindle hub.

Because doors vary in thickness, the plane defined by the trim assembly 10 will be at different distances from the center line plane located between the spindle hubs 94, 96. In order to maximally engage the spindle hub, the distance that the spindle 12 projects beyond the trim assembly 10 must vary. This variation is achieved through the axial retractable sliding motion of spindle 12 in the direction of arrow B along axis A (as shown in FIG. 1) provided by this invention.

Figure 2:
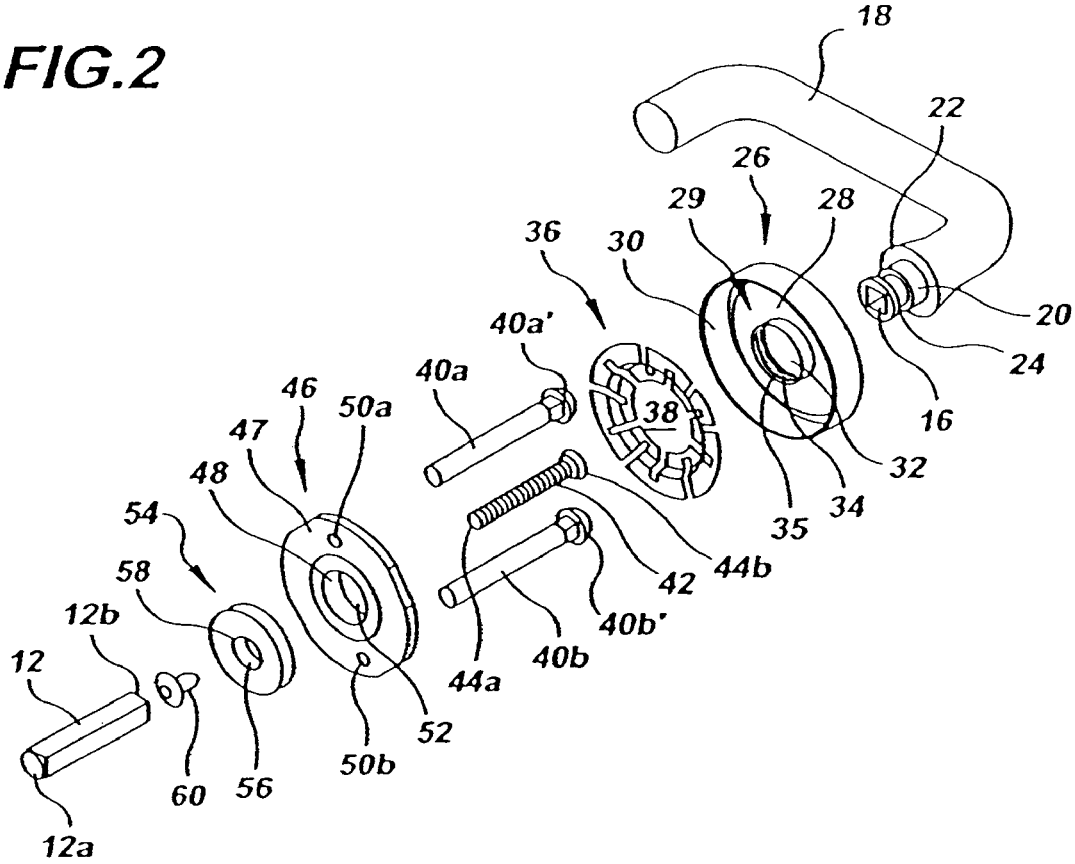
FIG. 2 is an exploded view of the trim assembly incorporating the retracting spindle mechanism of the present invention seen in FIG. 1.

Referring to FIGS. 1 and 2 the integrated trim assembly will now be described in detail. Spindle 12 slides axially in the direction of arrow B within a square spindle opening 16 in handle 18 and can therefore be used for doors of varying thicknesses since the spindle will be urged into hub 94 opening 98 as seen in FIG. 8 by a spring in the trim assembly.

FIG. 1 is a perspective view of the mortise lock integrated trim assembly with a retracting spindle and is shown generally as numeral 10. The assembly comprises a lever handle 18 and an axially disposed spindle 12 along plane A. This is the same plane for operating the lock as shown in FIG. 8. The spindle is preferably square and is disposed in a square opening 16 in handle 18 so that when handle 18 is turned, spindle 12 likewise turns. A cover 26 is shown holding a mounting plate 46 which plate is secured to the cover. Two mounting posts 40*a* and 40*b* are shown extending axially outward from mounting plate 46. The posts are through bolts and pass through openings in the door and lock from alignment of the trim to the lock. Two screws from the opposed side of the door are threaded into post openings 41*a* and 41*b* to secure the trim mechanism to the door.

The cover 26 including the mounting plate 46 and mounting posts 40*a* and 40*b* can freely rotate about a bearing surface of an extension 20 (shown on FIG. 5) on the handle. A cap nut 54 is threaded onto external threads on the extension of the handle (not shown in this figure) and holds the cover and mounting plate in place. As will be described hereinbelow, the cap nut 54 preferably has a star shaped face wherein when four edges of the star face engage with the edges of the square spindle 12 the cap nut 54 cannot loosen during use of the lock. It should also be noted that the cover, mounting posts, and mounting plate can be assembled separately and then fit onto the handle and secured by the cap nut.

Referring now to FIG. 2, this figure shows an exploded view of the preferred mortise lock integrated trim assembly with a retracting spindle as shown in FIG. 1. The handle 18 is shown having a smaller diameter extension 20 with the end of the extension threaded with external threads. An axial blind opening 16 is provided in the handle and extension along plane A. The extension 20 and handle 18 form a shoulder 22. A circular cover 26 is shown having a flat base 28 and an outer lip 30 around the periphery of the cover. The cover also has an inner through opening 32 having an inner lip 34 with internal threads 35. The cover 26 may be any shape, e.g., square, rectangular, etc.

A circular disc spring 36 is shown having a through opening 38. The disc spring 36 fits into the annular space 29 between outer lip 30 and inner lip 34 of cover 26. The disc spring, as will be more fully discussed hereinbelow, is a flexible piece of metal or other suitable material having a step construction and slots so that it can easily bend when a force is applied. Mounting posts 40*a* and 40*b* are used to align the assembly in the door frame and door lock and fit through openings 50*a* and 50*b* respectively in mounting plate 46. The posts are secured in the annular space 29 by enlarged heads 40*a*' and 40*b*'. Mounting plate 46 comprises a flat plate 47 and is shown having a through opening 52 and an inner lip 48. The inner lip has external threads 49 for threading onto the inner threads 35 of cover 26 as will be described hereinbelow. The mounting plate can be made in one piece or can be made by securing an inner lip 48 flange to flat plate 47.

A cap nut 54 has a through opening 56 and a star shaped design 58 on its face. The cap nut 54 has internal threads 62 (not shown) for threading onto the exterior threads 24 of handle 18 and secures together the handle, cover, disc spring, posts and mounting plate.

An elongated spring 42 is shown having a front end 44*a* and rear end 44*b*. The spring is disposed in opening 16 of handle 18. The spindle 12 is shown as square and fits into the square opening 16 in handle 18. The spindle 12 has a preferable front beveled end 12*a* and a rear-beveled end 12*b*. Not seen in this figure but as described below, the rear end 12*b* preferably has an axial opening to accommodate an anchor 60 which fixedly engages with the front end 44*a* of spring 42 securing the spindle in the assembly and enabling the spindle to be retracted.

The making of the assembly of FIG. 1 may be described with relation to FIG. 2. Accordingly, cover 26 is placed onto extension 20 of handle 18 and the base 28 rests against shoulder 22. The disc spring 36 is disposed in the angular space 29 of cover 26 between lips 30 and 34. Mounting posts 40*a* and 40*b* are disposed in openings 50*a* and 50*b* respectively of mounting plate 46 and mounting plate 46 is threaded into the threaded opening 32 of cover 26. The cap nut 54 is then threaded onto the external thread 24 of handle 18. This assembly may be made separately and fit onto the handle.

Spring 42 is then disposed in spindle opening 16. The spindle with anchor 60 is then inserted through opening 56 of cap nut 54 and forced into opening 16 of handle 18 to engage spring 42. Note that the star opening 58 on the face of cap nut 54 have to be rotated to mate with the edges of spindle 12. When the star opening 58 is properly aligned, the spindle 12 can be forced into opening 16 engaging the spring and completing the assembly.

An important feature of the invention is the star design 58 on the face of the cap nut 54 because once the spindle is secured in the opening in the lever handle, cap nut 54 cannot rotate during use and the assembly will remain secure and tight during use of the assembly.

Figure 3:
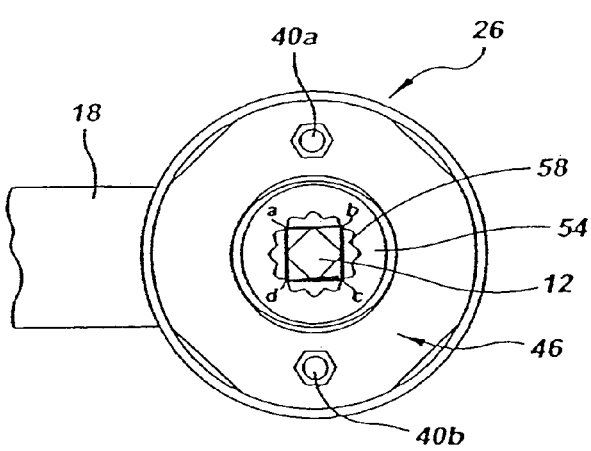
FIG. 3 is a front view of the trim assembly of FIG. 1.

Referring now to FIG. 3, a front view of the assembly of FIG. 1 is shown. As can be seen, lever handle 18, cover 26 and mounting plate 46 are secured in place by cap nut 54. The star design 58 of cap nut 54 has been rotated so that the edges a, b, c, and d of spindle 12 mate with corresponding four edges of the star design. Mounting posts 40*a* and 40*b* are also shown extending from the assembly.

Figure 4:
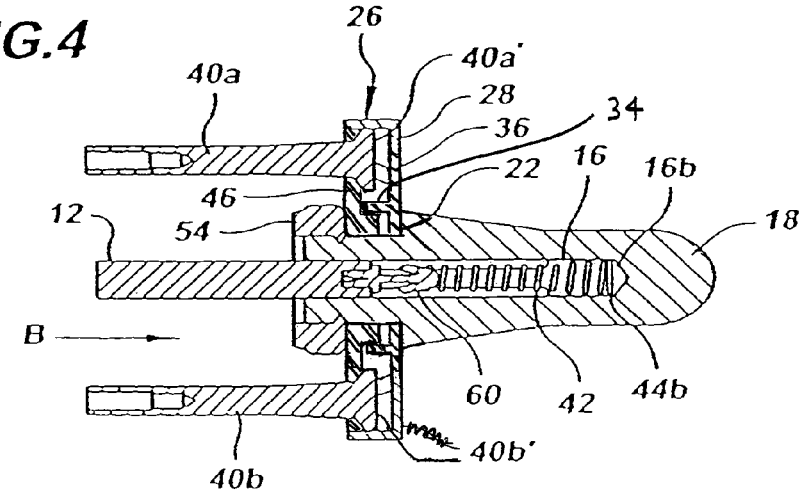
FIG. 4 is a cross-sectional view taken along lines 4—4 of FIG. 1.

FIG. 4 shows a cross-sectional view of the assembly of FIG. 1 taken along lines 4—4. Handle 18 with opening 16 accommodates spring 42 and spindle 12 is secured to the spring by anchor 60. The end 44*b* of spring 42 rests against the end 16*b* of the opening 16. The base 28 of cover 26 rests against shoulder 22 of handle 18 and disc spring 36 is shown urging against the heads 40*a*' and 40*b*' of mounting posts 40*a* and 40*b*. The disc spring 36 and mounting posts 40*a* and 40*b* are held in the annular space in cover 26 by mounting plate 46 which is threaded into the cover plate 26. Cap nut 54 is threaded onto the threads 24 of handle 18 completing the assembly. Spindle 12 can be retracted in the axial direction shown by arrow B.

Figure 5:
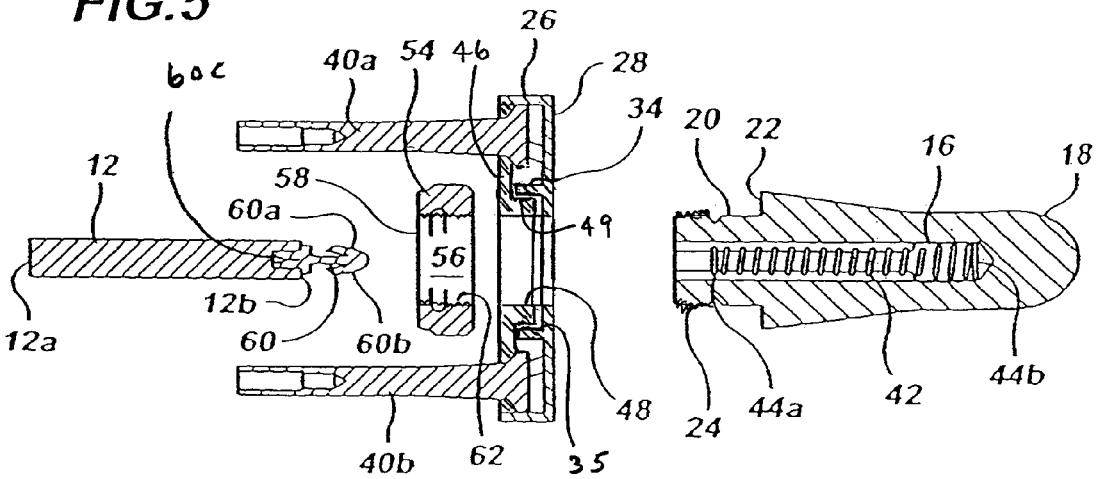
FIG. 5 is an exploded view of the cross-sectional view of FIG. 4.

FIG. 5 is an exploded view of the assembly of FIG. 4 and shows the handle 18, opening 16, shoulder 22, extension 20 and external threads 24. Spring 42 is disposed in opening 16. Cover 26 having a cover base 28 is shown holding disc spring 36 and mounting posts 40*a* and 40*b* with mounting plate 46. Cap nut 54 is shown having the star points 58 and through opening 56. Internal threads 62 of the cap nut will be threaded onto external threads 24 of handle 18 to secure the assembly together. The spindle 12 is shown having a front end 12*a* and rear end 12*b* with the rear end having an axial opening 12*c*. Base 60*c* of anchor 60 is force fit into spindle opening 12*c* and has prongs 60*a* and 60*b* which will engage with spring 42 so that the spindle 12 is preferably held together with spring 42.

Spring 42 is preferably a spring which is conical proximate its rear end 44*b*. A conical spring can collapse to a greater extent than a conventional coil spring. Preferably, the conical spring 42 is constructed so that the inner diameter of each succeeding coil becomes progressively smaller such that the conical coils can be compressed until it is substantially flat with each coil lying inside of its adjacent coil. This permits the maximum axial motion for the spindle 12 while simultaneously providing the maximum engagement between spindle 12 and the spindle opening 98 in spindle hub 94 as shown in FIG. 8.

Figure 6A:
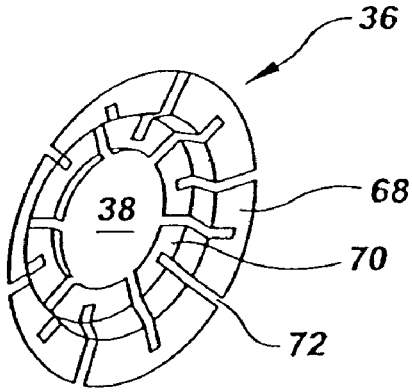
FIG. 6A is a perspective view of a disc spring used in the assembly of the invention.
Figure 6C:
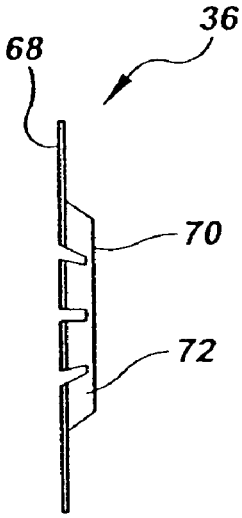
FIG. 6C is a side view of the disc spring of FIG. 6A.
Figure 6B:
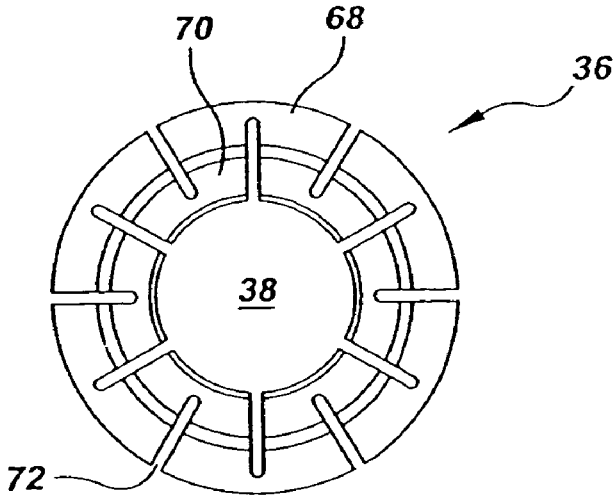
FIG. 6B is a front view of the disc spring of FIG. 6A.

FIGS. 6A–6C show a preferred disc spring of the invention having a through opening 38.

The spring is made of a thin material, preferably metal, which bends when a force is applied thereto. The spring shown is circular having an outer raised portion 68 and a connected lower inner portion 70. A series of slots 72 provide additional flexibility. Any suitable spring may be employed which deforms when a force is applied thereto. In the present trim mechanism, support pins are forced against the outer raised portion of the spring deforming the spring and enabling the pins to move axially and also laterally within the opening of the mounting plate.

Figure 7:
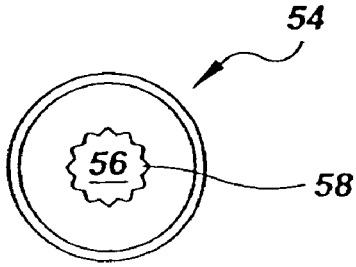
FIG. 7 is a front view of a cap nut used in the assembly of the invention.

FIG. 7 shows a preferred cap nut of the invention 54 having a through opening 56 and a star shaped face 58.

The spindle anchor, disc spring and cap nut are important to join together the components of the assembly. The disc spring also prevents the cover from turning loose.

It will be understood that the mortise lock of FIG. 8 shows only a very limited subset of the components therein which may include locking mechanisms, deadbolt assemblies and the like. Further, the retracting spindle mechanism 10 of FIG. 1 may be modified for use with other types of handles particularly where some portion of the mechanism limits the extent to which the spindle 12 may extend outward beyond the surface of the door.

Figure 10A:
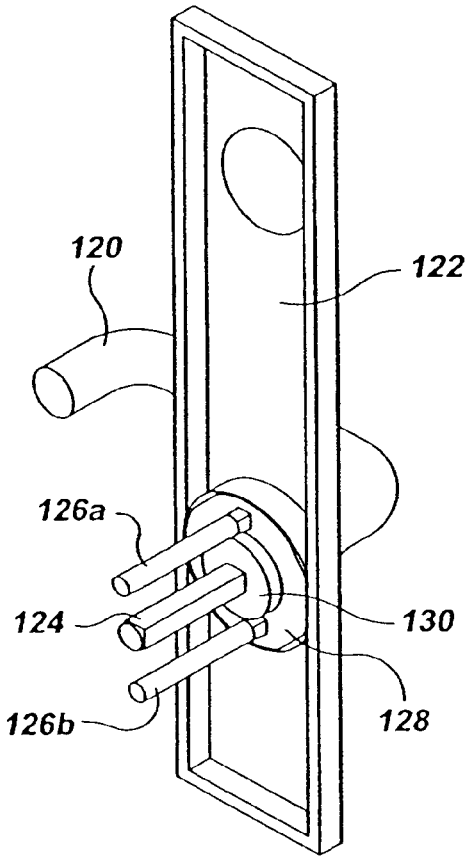
FIGS. 10A and 10B show perspective rear and front views of an assembly of the invention used with an escutcheon instead of a circular rosette.
Figure 10B:
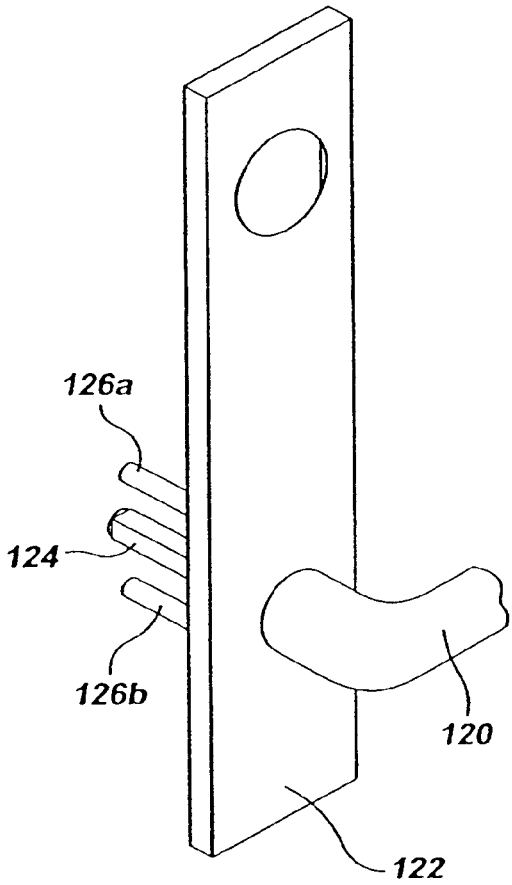

Referring now to FIGS. 10A and 10B an assembly of the invention is shown using an escutcheon 122 instead of a circular rosette. The figures show a handle 120 which extends through an escutcheon 122 and is secured to the escutcheon by mounting plate 128 and cap nut 130. Mounting pins 126*a* and 126*b* extend axially from the mounting plate as does spindle 124. The embodiment shown in FIGS. 10A and 10B operate in the same way as shown in the figures above in that turning the handle 120 turns the spindle 124 which is attached to a mortise lock.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An integrated door lock handle and trim assembly having a retractable spindle for operating a mortise door lock comprising:

a door lock handle having a support shoulder and external threads at the end of the handle and an axial blind opening in the handle for accommodating an elongated spring and an elongated spindle;

a cover having a base and a door facing outer lip around the base periphery and an internal threaded through opening in the base and the base rests against the shoulder of the door lock handle;

a mounting plate sized to fit within the outer lip and having a through opening with a lip having external threads which are to be threaded with the internal threads of the opening in the base of the cover the through opening of the mounting plate sized to allow the cover and threaded mounting plate to rotate freely on the handle;

a cap nut having a through opening with internal threads which are to be threaded with the external threads of the handle forming an integral assembly of the handle, cover, mounting plate and cap nut;

an elongated spring disposed within the axial opening of the handle having a front end and a rear end resting against the end of the blind opening; and an elongated spindle sized to extend through the cap nut opening, mounting plate opening and the axial opening in the handle and having a front end shaped to engage and operate the door lock and a rear end which is secured to the front end of the spring;

elongated support pins having an enlarged end held in the assembly between the mounting plate and cover base with the free ends of the pins extending axially through support pin openings in the mounting plate; and a spring disposed between the enlarged ends of the support pins and the base of the cover and contacting the enlarged ends of the elongated support pins;

whereas the spindle can be retracted within the axial opening decreasing the effective length of the spindle enabling the assembly to be used for doors of varying thicknesses.

2. The trim assembly of claim 1 wherein the cap nut has a star face opening which edges of the opening engage the spindle to prevent the spindle from turning.

3. The trim assembly of claim 2 wherein the spindle is rectangular.

4. The trim assembly of claim 3 wherein the rear end of the spindle has an axial opening to accommodate an anchor to connect the spindle and anchor together.

5. The trim assembly of claim 4 wherein the rear end of the elongated spring is conical so that when compressed the spring collapses to a greater extent than a conventional spring.

6. The trim assembly of claim 1 which is pre-assembled.

7. The trim assembly of claim 1 wherein the rear end of the spindle is shaped to engage the front end of the spring.

8. The trim assembly of claim 1 wherein the cover is an escutcheon.

9. An integrated door lock handle and trim assembly having a retractable spindle for operating a mortise door lock is provided comprising:

a door lock handle having a support shoulder formed by an elongated extension of smaller size at the end facing the door with the handle having external threads at the end of the extension and an axial blind opening in the extension and handle for accommodating an elongated spring and an elongated spindle;

a cover having a base and a door facing outer lip around the base periphery and an internal threaded through opening in the base and the base rests against the shoulder of the door handle;

a mounting plate sized to fit within the outer lip and having a through opening with a lip having external threads which are to be threaded with the internal threads of the opening in the base of the cover the through opening of the mounting plate sized to allow the cover and threaded mounting plate to rotate freely on the handle;

a cap nut having a through opening with internal threads which are to be threaded with the external threads of the handle forming an integral assembly of the handle, cover, mounting plate and cap nut;

an elongated spring disposed within the axial opening of the extension and handle having a front end and a rear end resting against the end of the blind opening; and an elongated spindle sized to extend through the cap nut opening, mounting plate opening and the axial opening in the handle and having a front end shaped to engage and operate the door lock and a rear end which is secured to the front end of the spring;

elongated support pins having an enlarged end held in the assembly between the mounting plate and cover base with the free ends of the pins extending axially through support pin openings in the mounting plate; and a spring disposed between the enlarged ends of the support pins and the base of the cover and contacting the enlarged ends of the elongated support pins;

whereas the spindle can be retracted within the axial opening decreasing the effective length of the spindle enabling the assembly to be used for doors of varying thicknesses.

10. The trim assembly of claim 9 wherein the cap nut has a star face opening which edges of the opening engage the spindle to prevent the spindle from turning.

11. The trim assembly of claim 10 wherein the spindle is rectangular.

12. The trim assembly of claim 11 wherein the rear end of the spindle has an axial opening to accommodate an anchor to connect the spindle and anchor together.

13. The trim assembly of claim 12 wherein the rear end of the elongated spring is conical so that when compressed the spring collapses to a greater extent than a conventional spring.

14. The trim assembly of claim 9 which is pre-assembled.

15. The trim assembly of claim 9 wherein the rear end of the spindle is shaped to engage the front end of the spring.

16. The trim assembly of claim 9 wherein the cover is an escutcheon.

* * * * *